United States Patent [19]

Shepard

[11] Patent Number: 4,720,038

[45] Date of Patent: Jan. 19, 1988

[54] CORNER STRUCTURE

[75] Inventor: John K. Shepard, Bolingbrook, Ill.

[73] Assignee: Continental Forest Industries, Inc., Stamford, Conn.

[21] Appl. No.: 420,059

[22] Filed: Sep. 20, 1982

[51] Int. Cl.[4] ..... B65D 3/30

[52] U.S. Cl. ..... 229/5.7; 220/67; 220/73

[58] Field of Search ..... 229/5.7; 220/67, 73

[56] References Cited

U.S. PATENT DOCUMENTS

| | | | |
|---|---|---|---|
| 1,847,110 | 3/1932 | Halub | 229/5.7 |
| 2,089,527 | 8/1937 | Andrew | 229/5.7 |
| 2,192,424 | 3/1940 | Wilson | 229/5.7 |
| 2,334,041 | 11/1943 | Scott | 220/67 |
| 3,133,686 | 5/1964 | Rabby | 229/5.6 |
| 3,187,974 | 6/1965 | Radish | 229/5.7 |
| 3,385,499 | 5/1968 | Hunkins | 229/5.7 |
| 3,814,041 | 6/1974 | Redd | 229/5.7 |
| 4,135,657 | 1/1979 | Benson | 229/5.7 |

FOREIGN PATENT DOCUMENTS

| | | | |
|---|---|---|---|
| 498403 | 12/1953 | Canada | 220/67 |
| 802038 | 5/1936 | France | 220/67 |
| 1066004 | 1/1954 | France | 220/67 |

*Primary Examiner*—Stephen Marcus
*Assistant Examiner*—Gary E. Elkins
*Attorney, Agent, or Firm*—Charles E. Brown

[57] ABSTRACT

This relates to a fibre drum construction and more particularly to the reinforcement of the chime which is utilized to shape an end part of a fibre drum body to receive and tightly clamp in sealed relation the periphery of the drum wall. The end part of a conventional chime includes a plurality of flanges arranged to define a radially inwardly directed channel with the lowermost flange terminating in a curl. The endmost flange, which is annular, is provided with radiating ribs which project axially inwardly into the overlying portion of the drum body and serve to rigidify the channel. The ribs extend vertically into a vertical flange of the flanges and terminate generally within the curl, with the ribs extending entirely across the end flange.

9 Claims, 3 Drawing Figures

CORNER STRUCTURE

This invention relates in general to new and useful improvements in fibre drums, and more particularly to a top or bottom corner structure which is so reinforced as greatly to increase impact strength of the corner when the filled drum is dropped onto the corner.

This invention particularly relates to an improvement in the construction of the customary metal chime which serves to shape the top or bottom portion of the drum body and to clamp within the shaped drum body corner portion the drum bottom wall. In particular, the invention relates to the provision of the end part of the chime with stiffening ribs, which ribs extend transversely of the end part of the chime in general and in a specific example radially of the chime.

It is known in the fibre drum art to provide the reinforcing chime with ribs which serve to reinforce the chime. Particular attention is directed to Rodish, U.S. Pat. No. 3,187,974, granted June 8, 1965. However, this patent teaches that the bottom flange only of the bottom chime be provided with ribs, and these ribs are circumferential ribs and not radial ribs. The ribs of Rodish do not perform the same function as the ribs of this invention.

With the above and other objects in view that will hereinafter appear, the nature of the invention will be more clearly understood by reference to the following detailed description, the appended claims, and the several view illustrated in the accompanying drawings.

IN THE DRAWINGS

Figure 1:
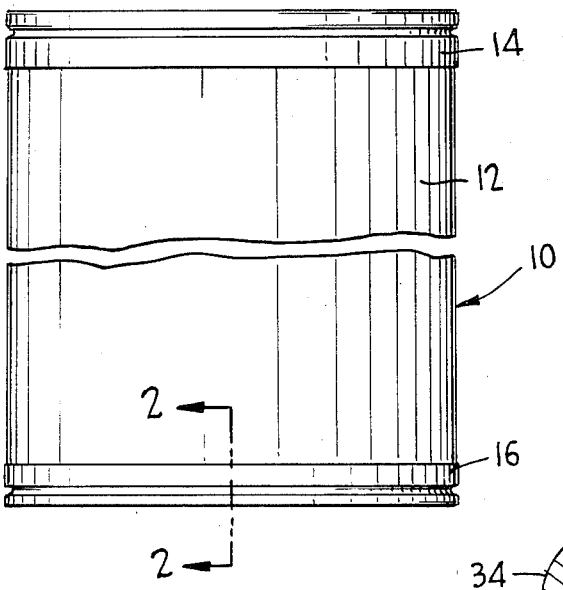
FIG. 1 is an elevational view of a fibre drum incorporating the invention.

Referring now to the drawings in detail, in FIG. 1 there is illustrated a conventional type of fibre drum generally identified by the numeral 10 and incorporating the features of the invention.

The fibre drum 10 includes a drum body 12 which is cylindrical and which is reinforced at its upper and lower ends by metal chimes 14 and 16, respectively. The fibre drum 10 may be tighthead or is provided with a removable cover (not shown) which is associated with the chime 14.

Figure 2:
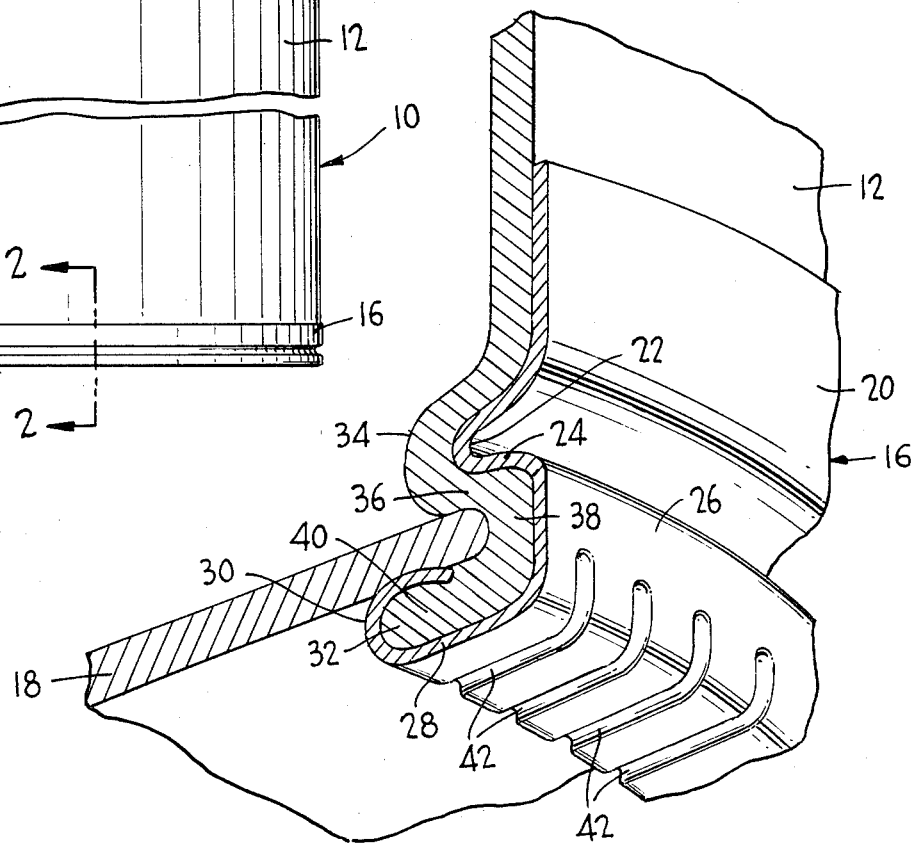
FIG. 2 is an enlarged fragmentary perspective sectional view taken generally along the line 1—1 of FIG. 1, and shows the specifics of the corner construction.
Figure 3:
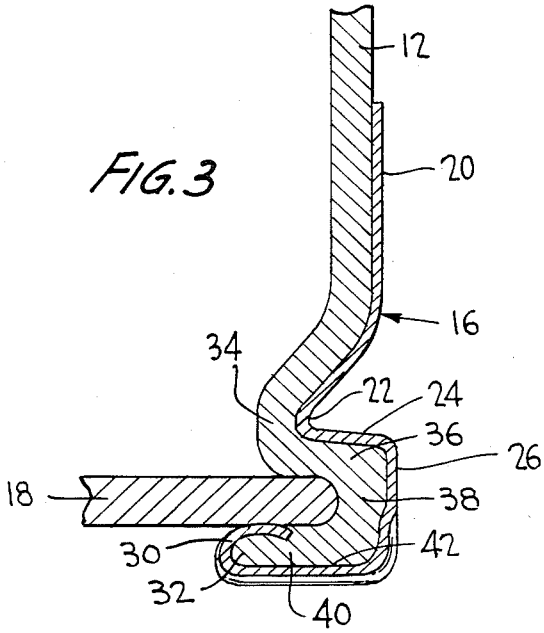
FIG. 3 is a sectional view in elevation taken along the line 3—3 of FIG. 1, and shows the specifics of the chime reinforcement.

The illustrated fibre drum 10 also includes an end wall 18 which is clearly shown in FIGS. 2 and 3, which end wall is tightly engaged with the drum body 12 in sealed relation and is held in place by the action of the chime 16.

The chime 16 is of a conventional cross section except for the specifics of the invention which will be described in detail hereinafter. The chime 16 is formed of sheet metal and is annular in configuration. The chime 16 includes a cylindrical portion 20 which terminates in an outwardly directed bead 22 with an end part of the bead 22 being in the form of a radially inwardly directed flange 24. The outer end of the flange 24 is connected to a lower or bottom annular flange 28. The flanges 24, 26 and 28 define a generally channel shaped portion of the chime 16.

The flange 28 terminates in a transversely and axially inwardly turned curl 30 which is engaged about a free end portion 32 of the associated end of the drum body 12.

The channel defined by the flanges 24, 26 and 28 in combination with the bead 22 defines in the end part of the drum body 12 a radially inwardly directed bead 34 which includes a leg 36. The leg 36 forms the upper part of a radially inwardly opening channel which also includes a vertical portion 38 and a horizontal portion 40 of the drum body 12. Into this channel projects a peripheral portion of the drum body wall 18.

Fibre drums, constructed as defined above, have been subjected to drop tests wherein the drums are subjected to a bottom diagonal drop where the filled drums drop on their corners, and when the chimes 16 are formed of specified gauge metal, no drum passed the test. However, the same drums using the same chime thicknesses, but improved in accordance with this invention, were more successful. Most specifically, in accordance with the invention the flange 28 is provided with a plurality of upstanding ribs 42 which are spaced about the circumference of the flange 28 and compressively engage the portion 40 of the drum body 12. These ribs are preferably radially extending ribs and are thus perpendicular to the circumference of the chime. The ribs could, however, be slightly sloped.

As is best shown in FIG. 3, each rib 42 extends partially the height of the cylindrical flange 26 and terminates generally in the plane of the end wall 18. Further, as shown in FIG. 3, each rib 42 extends at least partially into the curl 30.

The most efficient method of forming the ribs or ridges 42 is to incorporate the ridges into the curl rings of standard crimping tooling. However, the ribs 42 could be formed in the chime in a later, supplementary operation such as by roll forming or by some means of reciprocating embossment tooling with the container periphery being automatically indexed into the embossing station.

When the specified inch thickness chime is formed with the ribs or ridges 42, as illustrated in FIGS. 2 and 3, 100% of the drums passed the drop test.

It will be seen that by forming the ribs in a radial direction as opposed to a transverse direction, a material tightening of the bottom portion of the drum body 12 is effected, and when the drum is dropped on the corner of the chime 16, the connection will not be materially loosened even though the channel defined by the flanges 24, 26 and 28 may be slightly deformed.

The generally radial orientation of the ribs also results in a significant increase in the abuse resistance of the container side wall. The frequent and regular interruption of the normally smooth container corner periphery by the reinforcing ribs results in a more controlled and gradual deformation of the drum during drop tests with resultant reduction of concentrated stresses in the container side wall.

The drum end specifically illustrated and described herein has been with reference to the bottom of the drum 10 and the bottom chime 16. However, it is to be understood that when the drum 10 is of the tighthead type, the top end of the drum and the top chime 14 will be of a construction corresponding to that illustrated in FIGS. 2 and 3 and specifically described.

Although only a preferred embodiment of the drum construction has been specifically illustrated and described herein, it is to be understood that minor variations may be made in the drum and particularly in the chime without departing from the spirit and scope of the invention as defined by the appended claims.

I claim:

1. In a drum of the type including a tubular body, an end wall and a corner reinforcement in the form of a metal chime, said chime having a corner portion including an annular end flange and a cylindrical upstanding flange; the improvement residing in upstanding ribs extending transversely across said annular end flange towards the interior of said drum, said ribs extending beyond said annular flange into said cylindrical flange with each of said ribs being generally of an L-shape.

2. In a drum according to claim 1 wherein said drum is cylindrical and said ribs extend radially inwardly.

3. In a drum assembly according to claim 1 wherein said ribs terminate in said cylindrical flange.

4. In a drum assembly according to claim 1 wherein said ribs terminate in said cylindrical flange generally in the plane of said end wall.

5. In a drum according to claim 1 wherein said end wall is selectively a top end wall or a bottom end wall.

6. In a drum of the type including a tubular body, an end wall and a corner reinforcement in the form of a metal chime, said chime having a corner portion including an annular end flange and a cylindrical upstanding flange; the improvement residing in upstanding ribs extending transversely across said annular end flange towards the interior of said drum, said chime having an end portion in the form of a generally radially inwardly opening channel of which said chime corner portion is a part, said body having an end part whithin said chime channel, said drum end part also being channel shaped and including spaced legs, and said end wall having a peripheral portion clamped betwen said drum body legs by said chime.

7. In a drum assembly according to claim 6 wherein said annular end flange terminates in a reversely turned curl having a free end portion positioned between one of said body end legs and said end wall.

8. In a drum assembly according to claim 6 wherein said annular bottom flange terminates in a reversely turned curl having a free end portion positioned between one of said body end legs and said bottom wall, and said ribs extend into said curl.

9. In a drum according to claim 8 wherein said ribs extend beyond said annular flange into said cylindrical flange with each of said ribs being generally of an L-shape.

* * * * *